United States Patent [19]

Mareels et al.

[11] Patent Number: 4,722,435

[45] Date of Patent: Feb. 2, 1988

[54] CASE FOR DOCUMENTS

[75] Inventors: Marc Mareels, Hoogstraat 34, 9498 Appelterre; Michel Moerman, Heusden, both of Belgium

[73] Assignee: Marc Mareels, Appelterre, Belgium

[21] Appl. No.: 820,406

[22] Filed: Jan. 17, 1986

[30] Foreign Application Priority Data

| | | | |
|---|---|---|---|
| Jan. 18, 1985 | [BE] | Belgium | 4/4454 |
| Feb. 1, 1985 | [BE] | Belgium | 4/4456 |
| Mar. 21, 1985 | [BE] | Belgium | 0/214680 |

[51] Int. Cl.[4] ..... E05G 1/17

[52] U.S. Cl. ..... 206/1.5; 109/25; 109/33; 109/40; 109/41; 70/214; 70/220

[58] Field of Search ..... 206/1.5, 38; 109/25, 109/32, 33, 34, 40, 41, 42, 49 S, 59 R, 59 T; 70/214, 220

[56] References Cited

U.S. PATENT DOCUMENTS

| | | | |
|---|---|---|---|
| 1,097,587 | 5/1914 | Hammond | 109/42 |
| 1,223,583 | 4/1917 | Hitchcock | 109/42 |
| 1,538,223 | 5/1925 | Smyers, Jr. et al. | 109/42 |
| 1,606,516 | 11/1926 | Daly | 109/25 |
| 2,047,707 | 7/1936 | Regan | 109/25 |
| 2,073,820 | 3/1937 | Von Berg | 109/25 |
| 3,349,729 | 10/1967 | Olivier | 109/25 |
| 3,424,122 | 1/1969 | De Angelis | 116/2 |
| 4,234,875 | 11/1980 | Williams | 109/41 |
| 4,236,463 | 12/1980 | Wescott | 109/33 |
| 4,274,272 | 6/1981 | Wang et al. | 70/214 |
| 4,299,176 | 11/1981 | Loehle | 109/34 |
| 4,391,203 | 7/1983 | Millar | 109/25 |

FOREIGN PATENT DOCUMENTS

| | | | |
|---|---|---|---|
| 2445429 | 12/1978 | France . | |
| 2478040 | 9/1981 | France | 109/25 |
| 7802003 | 9/1978 | Netherlands . | |
| 1138104 | 12/1968 | United Kingdom . | |
| 2006322 | 10/1978 | United Kingdom . | |

*Primary Examiner*—Stephen Marcus
*Assistant Examiner*—David Fidei
*Attorney, Agent, or Firm*—Fitch, Even, Tabin & Flannery

[57] ABSTRACT

There is described a case for valuable documents, such as notably checks, credit cards, bank notes, etc., comprised of a box with a lid and a closure which may only be opened by inputting a code number, as well as a capsule or phial filled with a pressurized liquid which can destroy or make useless said documents, in which said capsule or phial is made completely or partly from fusible material, and said capsule or phial may be opened or unplugged electrically when electric or electronic means the case is fitted with, are operated due to any break-in attempt.

7 Claims, 2 Drawing Figures

CASE FOR DOCUMENTS

BACKGROUND OF THE INVENTION

This invention relates to an enclosure or case for valuable documents, such as checks, credit cards, bank notes, etc.

1. Field of the Invention

The invention object is to provide a case of this type the content of which will be destroyed or made useless with a break-in attempt.

There are already known various arrangements for cases when conveying valuable documents which destroy the contents of the case when an unauthorized entry is attempted.

2. Description of Prior Art

In French Patent No. 2,445,429 dated Dec. 26, 1978, there is describeda safety container for conveying valuable documents which insures mechanical destroying or marking of the enclosed documents with an unauthorized opening attempt. This is actually a container with a relatively large size the walls of which comprise a lamination including electric conductors connected to an electronic lock which will receive specific signals from a terminal in the opening or closing locations. The object is here to protect large-scale conveying between defined locations.

A Great-Britain Patent No. 2,006,322 dated Oct. 26, 1978 discloses a safety enclosure for credit cards, provided with a mechanical-combination lock and mechanical means causing projecting of a material which makes the credit cards unusable with a break-in attempt. Said mechanical means are sensitive and thus bring a danger of accidental triggering even for the authorized user.

On the other hand, the protection is uncomplete, the large-area sides of the container are not protected, but only the edges and the connecting areas. The manufacture of the container and the mechanisms thereof is intricate and accurate, thus of course costly.

SUMMARY OF THE INVENTION

According to this invention, to the contrary, there is provided a very simple case, with a small size, which may be put in a pocket by the user thereof, and which allows conveying on a personal basis, valuable documents. The case encloses a capsule containing a liquid which can destroy or make unusable the documents. Said capsule is made from a fusible material, as a whole or in part. Said capsule may also be closed with a plug made from such a material. The case comprises electric means for opening or unplugging the capsule in the case of a break-in attempt on the case.

Said electric means are usefully comprised of a glow wire, which contacts or phial, or the plug thereof.

Other details and features of the invention will stand out from the following description, given by way of non limitative example and with reference to the accompanying drawings, in which:

DESCRIPTION OF THE PREFERRED EMBODIMENT

Figure 1:
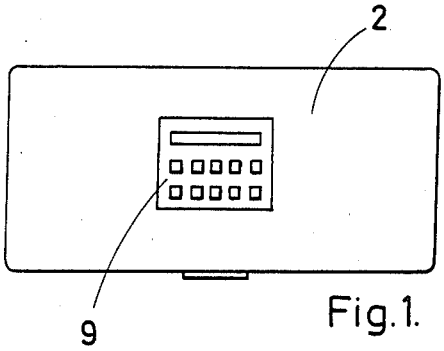
FIG. 1 is a front view of the document case according to the invention.
Figure 2:
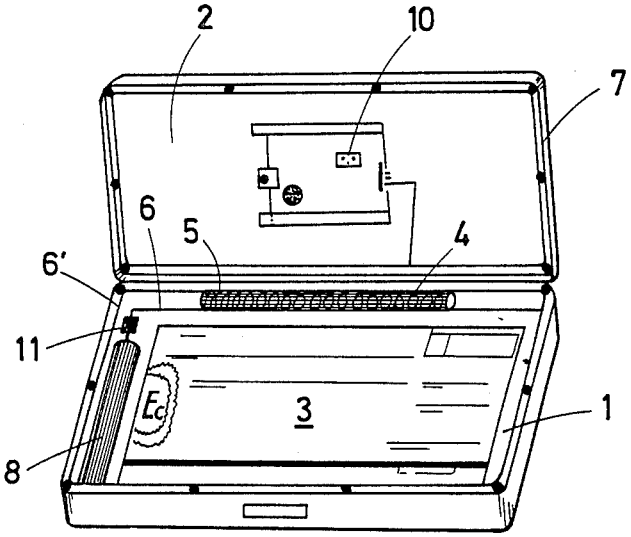
FIG. 2 is a perspective view of the case according to the invention, in open condition.

The case according to the invention is comprised of a box 1 with a lid 2. There will be noticed in FIG. 2 the location provided for checks 3 for example. Inside the box 1, a capsule or phial 4 is mounted on the side, which contains a pressurized liquid which as it contacts the valuable documents 3, makes same unusable. Such a liquid may for example be of the aniline type. The capsule 4 is made from a fusible material, or it is closed with an inflammable material, for example magnesium.

When the capsule 4 is made from a fusible material, a glow wire 5 is wound thereabout. The glow wire 5 is part of an electric circuit the leads 6 and 7 of which are notably visible. A battery 8 supplies the electric or electronic system this invention is based on.

A keyboard 9 is provided outwardly on the lid 2. The case is provided with a microprocessor which will be further described hereinafter, which stores a code number. When the adequate code number is inputted, the case may be opened. Electronic means are provided to cause that electric or electronic system which performs the valuable document destruction, to operate but after the successive inputting of two unvalid code numbers.

In those edges facing one another of the box and lid, two leads are embedded, among which said lead 7 belongs to the lid 2 and the lead 6' to the box 1.

With an attempt to open the case by slipping a metal implement between lid and box, the leads 6' and 7 are short-circuited, which energized wire 5 and raises same to the adequate temperature to melt that material the capsule 4 is made of. The liquid contained under pressure in capsule 4 is ejected with enough force outwards and reaches the valuable documents or checks 3, which are thus made useless. The capsule 4 may also be made from metal and be provided with a plug from fusible or inflammable material, such as magnesium, which is ignited in such a way that the pressurized liquid is ejected outwards with the same result.

According to this same principle, it is possible to consider a variation wherein the lid 2 and box 1 are made from metal, in such a way that by piercing with an electricity-conducting implement, such as a drill, the leads 6' and 7 are short-circuited with the same results as before.

It may be enough for example that the lid only, which may in such a case be made from synthetic material, should comprise an embedded electric lead network which with an attempt to pierce or break with a hammer lid 2, will cause the required short-circuit, in such a way that the glow wire 5 is again raised to the required temperature, in such a way that the capsule 4 melts or the plug thereof is ignited.

The destruction mechanism further comprises a microprocessor or "chip" 10 which monitors all the possible "entrances" to the case by means of a number of logic OR gates.

When such entrances or inputs are made unstable or broken, the microprocessor 10 couples a control pulse to an electric circuit part which may be comprised of an optoelectronic coupler, a thyristor 11 or a miniature relay. By means of this control system, the electric current originating from battery 8 will be fed to the glow wire 5. Said wire 5 may cause melting of capsule 4, but it may also as already stated hereinabove, cause igniting of the plug of a capsule or phial which is preferably made from metal.

When the code number is normally inputted, there is performed in the microprocessor a simulation which causes all the inputs to remain closed and by means of the output from microprocessor 10, an unlocking mechanism is operated which allows opening the case.

When the case is open, all the inputs or "entrances" then remain closed and contents may be inserted into or removed from the case. Closing the case results in "initializing" the electronic mechanism.

Finally it may further be noted that the case is provided with a "clock" or time-control means, designed for a 24-month period, for example. There will thus be determined the moment in time for maintaining those components which insure destroying or unvalidating the valuable documents. The case owner is warned in due time that the batteries are to be replaced, by means of a signal which lights up a LED for example.

It must be understood that the invention is in no way limited to the above embodiments, and that many changes may be made therein without departing from the scope of the invention as defined by the appended claims.

We claim:

1. A case for the protection of documents, comprising:

a closure having box and lid portions which are movable between a closed position and an open position which provides access to the interior of the closure;

locking means for locking said closure in said closed position, said locking means being unlockable in response to a selected command to allow at least one of said box and said lid portions to be moved to said open position;

an electrical energy source within said closure;

capsule means within said closure containing a pressurized liquid material for at least partially destroying the documents when placed in contact therewith, said capsule means having a fusible portion which is openable in response to an electrical opening signal;

microprocessor means having a plurality of logical OR gates, connected to said electrical energy source, having a plurality of inputs and an output connected to said capsule means for generating said electrical opening signal in response to at least one of said inputs being activated;

reeiving means for receiving code numbers and having an output connected to said locking means to send said selected command to said locking means in response to a valid code number being received by said receiving means; and sensing means for sensing various modes of attempted unauthorized entry into said closure connected to electrically activate said microprocessor means inputs, whereby said electrical opening signal is applied to said capsule means to release said liquid material to to said documents upon the sensing of an attempted unauthorized entry into said closure.

2. The case of claim 1 wherein said receiving means comprises electrical keyboard input means connected to said microprocessor means so as to initiate said electrical opening signal at said microprocessor output in response to an unvalid code number being received by said keyboard input means.

3. The case of claim 1 wherein said receiving means comprises electrical keyboard input means connected to said microprocessor means so as to neutralize keyboard entry upon two attempts to enter unvalid code numbers via said keyboard input means.

4. The case of claim 1 wherein said capsule means comprises a heat-softenable container surrounded by electrical heating means electrically connected to said microprocessor output.

5. The case of claim 1 wherein said capsule means comprises a container having an electrically ignitable cap closure.

6. A case for the protection of documents, comprising:

a closure having box and lid portions which are movable between a closed position and an open position which provides access to the interior of the closure;

locking means for locking said closure in said closed position, said locking means being unlockable in response to a selected command to allow at least one of said box and said lid portions to be moved to said open position;

an electrical energy source within said closure;

capsule means within said closure containing a pressurized liquid material for at least partially destroying the documents when placed in contact therewith, said capsule means having a fusible portion which is openable when energized by an electrical energy source;

means for connecting said electrical energy source to said capsule means so as to energize said fusible portion to release said liquid material onto said documents;

microprocessor means connected to said electrical energy source, having at least one input and at least one output connected to said locking means for generating said selected command in response to said at least one input being activated;

electrical keyboard input means for receiving code numbers and having an output electrically connected to said at least one microprocessor input, said electrical keyboard input means and said microprocessor means being connected to send said selected command to said locking means in response to a valid code number being received by said keyboard input means; and said keyboard input means and said microprocessor means being connected so as to neutralize keyboard entry upon two attempts to enter at least one unvalid code number via said keyboard input means.

7. The case of claim 6 wherein said means for connecting said electrical energy source to said capsule means so as to energize said fusible portion comprises an other microprocessor output connected to said capsule means and a plurality of microprocessor means inputs for initiating an electrical opening signal when at least one of said plurality of microprocessor means inputs is activated; and sensing means for sensing various modes of attempted unauthorized entry into said closure connected to electrically activate at least one of said plurality of microprocessor means inputs, whereby said electrical opening signal is applied to said capsule means to release said liquid material onto said documents upon the sensing of an attempted unauthorized entry into said closure.

* * * * *

UNITED STATES PATENT AND TRADEMARK OFFICE

CERTIFICATE OF CORRECTION

PATENT NO. : 4,722,435

DATED : February 2, 1988

INVENTOR(S) : Marc Mareels and Michel Moerman

It is certified that error appears in the above-identified patent and that said Letters Patent is hereby corrected as shown below:

Column 1, line 5, Preceding line 1 of the specification, at left-hand margin, insert the subheading:
--1. Field of the Invention--, Column 1, line 9, Delete "1. Field of the Invention", Column 1, line 19, Change "describeda" to --described a--, Column 1, line 37, Change "uncomplete" to --incomplete--, Column 1, line 58, After "contacts" insert --the capsule--.

Column 2, line 25, Change "unvalid" to --invalid--,

Column 2, line 31, Change "energized" to --energizes--

Column 2, line 34, Change "outwards" to --outward--,

Column 2, line 40, Change "outwards" to --outward--.

Column 3, line 14, Change "unvalidating" to --invalidating--,

Column 3, line 48, Change "reeiving" to --receiving--,

Column 3, line 58, Delete "to" (second occurence),

Column 3, line 64, Change "unvalid" to --invalid--.

Column 4, line 2, Change "unvalid" to --invalid--,

UNITED STATES PATENT AND TRADEMARK OFFICE

CERTIFICATE OF CORRECTION

PATENT NO. : 4,722,435

DATED : February 2, 1988

INVENTOR(S) : Marc Mareels et al

It is certified that error appears in the above-identified patent and that said Letters Patent is hereby corrected as shown below:

Column 4, line 49, Change "unvalid" to -- invalid --.

Signed and Sealed this

Twenty-eighth Day of February, 1989

*Attest:*

DONALD J. QUIGG

*Attesting Officer*

*Commissioner of Patents and Trademarks*